US007715584B2

(12) United States Patent
Proni

(10) Patent No.: US 7,715,584 B2
(45) Date of Patent: May 11, 2010

(54) LOUDSPEAKER WITH AIR DEFLECTOR

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 1165 days.

(21) Appl. No.: 11/324,428

(22) Filed: Jan. 3, 2006

(65) Prior Publication Data

US 2007/0154056 A1 Jul. 5, 2007

(51) Int. Cl.
*H04R 1/00* (2006.01)

(52) U.S. Cl. ..... 381/397; 381/396; 381/419

(58) Field of Classification Search ..... 381/396–397, 381/419

See application file for complete search history.

(56) References Cited

U.S. PATENT DOCUMENTS

| | | | |
|---|---|---|---|
| 1,759,725 | A | 5/1930 | Young et al. |
| 1,869,665 | A | 8/1932 | Chann |
| 1,915,217 | A | 6/1933 | Crosley, Jr. |
| 2,038,401 | A | 4/1936 | Wunderlich |
| 2,261,110 | A | 11/1941 | Engholm |
| 2,261,111 | A | 11/1941 | Engholm |
| 2,295,483 | A | 9/1942 | Knowles |
| 2,429,470 | A | 10/1947 | Knowles |
| 2,775,309 | A | 12/1956 | Willchur |
| 2,858,377 | A | 10/1958 | Levy |
| 3,328,537 | A | 6/1967 | Hecht |
| 3,991,286 | A | 11/1976 | Henricksen |
| 4,158,756 | A | 6/1979 | Keezer |
| 4,210,778 | A | 7/1980 | Sakurai et al. |
| 4,313,040 | A | 1/1982 | Tsukamoto |
| 4,327,257 | A | 4/1982 | Schwartz |
| 4,387,275 | A | 6/1983 | Shimada et al. |
| 4,418,247 | A | 11/1983 | Hansen |
| 4,433,214 | A | 2/1984 | Jasinski |
| 4,438,297 | A | 3/1984 | Kawamura |
| 4,547,632 | A | 10/1985 | Bryson |
| 4,577,069 | A | 3/1986 | Keezer |
| 4,590,332 | A | 5/1986 | Delbuck |
| 4,821,331 | A | 4/1989 | Murayama et al. |
| 4,933,975 | A | 6/1990 | Button |
| 5,042,072 | A | 8/1991 | Button |
| 5,081,684 | A | 1/1992 | House |
| 5,303,209 | A | 4/1994 | Frasl |
| 5,357,586 | A | 10/1994 | Nordschow |
| 5,426,707 | A | 6/1995 | Wijnker |
| 5,430,804 | A | 7/1995 | Wijnker |
| 5,497,428 | A | 3/1996 | Rojas |
| 5,625,701 | A | 4/1997 | Scanlan |

(Continued)

FOREIGN PATENT DOCUMENTS

| | | | |
|---|---|---|---|
| AU | 0542761 | B | 2/1985 |

(Continued)

*Primary Examiner*—Curtis Kuntz
*Assistant Examiner*—Ryan C Robinson
(74) *Attorney, Agent, or Firm*—Gray Robinson, P.A.

(57) ABSTRACT

An air deflector is positioned relative to the through bore in the pole piece of the motor structure of a speaker such that the flow of air entering and leaving a cavity overlying the voice coil and pole piece is directed along a flow path which passes in thermal communication with at least a portion of the inner surface of the former of the voice coil opposite the wire winding on the outer surface of the former.

7 Claims, 4 Drawing Sheets

U.S. PATENT DOCUMENTS

| | | | | |
|---|---|---|---|---|
| 5,734,734 | A | 3/1998 | Proni | |
| 5,909,015 | A | 6/1999 | Yamamoto et al. | |
| 5,940,522 | A * | 8/1999 | Cahill et al. | 381/397 |
| 6,088,466 | A | 7/2000 | Proni | |
| 6,118,884 | A | 9/2000 | Proni | |
| 6,243,479 | B1 | 6/2001 | Proni | |
| 6,370,257 | B1 * | 4/2002 | Bleim et al. | 381/409 |
| 6,535,613 | B1 * | 3/2003 | Ssutu | 381/397 |
| 6,837,333 | B2 * | 1/2005 | Howze | 181/148 |
| 2007/0297638 | A1 * | 12/2007 | McKenzie | 381/412 |

FOREIGN PATENT DOCUMENTS

| | | | |
|---|---|---|---|
| DE | 900 227 | A | 12/1953 |
| FR | 2667212 | A1 | 3/1992 |
| GB | 724113 | A | 2/1955 |
| JP | 1991-3-220897 | A | 9/1991 |
| JP | 1991-3-239099 | A | 10/1991 |

* cited by examiner

LOUDSPEAKER WITH AIR DEFLECTOR

FIELD OF THE INVENTION

This invention relates to loudspeakers, and, more particularly, to an air deflector which is located with respect to the through bore in the pole piece of the motor of the speaker to direct cooling air, flowing in and out of the cavity located between the voice coil and dust cap, along a flow path in thermal communication with the inner surface of the voice coil of the speaker.

BACKGROUND OF THE INVENTION

Loudspeakers generally comprise a frame, a motor structure, a diaphragm, a lower suspension and an upper suspension. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the upper suspension, which, in turn, is mounted to the upper end of the frame. The lower suspension is connected at one end to the frame at a point between its upper and lower ends. The free ends of the diaphragm and lower suspension are mounted to the outer surface of the former of the voice coil and support it within the magnetic gap formed between the pole piece and top plate of the motor structure such that the former of the voice coil is concentrically disposed about the pole piece. In some speaker designs, a dust cap is mounted to the diaphragm in a position overlying the voice coil and pole piece to protect them from contaminants. This forms a dust cap cavity between the dust cap, diaphragm, the voice coil and pole piece. In alternative designs, the upper end of the voice coil is connected directly to the diaphragm, thus eliminating the need for a dust cap but nevertheless forming an internal or dust cap cavity in the area directly above the voice coil and pole piece.

In the course of operation of a speaker of the type described above, electrical energy is supplied to the voice coil causing it to axially move relative to the pole piece within the magnetic gap of the motor. The diaphragm, upper suspension and lower suspension all move as a unit with the excursion of the voice coil. A pervasive problem associated with speaker operation involves the build up of heat produced in the wire winding of the voice coil, and by its axial movement, which is radiated to surrounding surfaces, particularly the top plate. Both the voice coil and top plate become quite hot during speaker operation which can reduce the power handling of the speaker, and increase power compression, i.e. a reduction in acoustic output due to temperature-related voice coil resistance.

A variety of designs have been employed in the prior art to address the problems associated with heat build up in speakers. One approach has been to create a flow of cooling air in thermal communication with the voice coil, such as disclosed, for example, in U.S. Pat. No. 5,042,072 to Button, U.S. Pat. No. 5,357,586 to Nordschow et al. and U.S. Pat. No. 5,426,707 to Wijnker. Speaker designs of this type generally include a pole piece formed with passages which provide a flow path for the transfer of cooling air from outside of the speaker into and out of the dust cap cavity described above. An air flow through these passages is created in response to movement of the diaphragm with the excursion of the voice coil. When the diaphragm moves in one direction, air is drawn from outside of the speaker, along the passages in or along the pole piece, and then into the dust cap cavity. Movement of the diaphragm in the opposite direction creates a flow out of the dust cap cavity along the reverse flow path.

In the Button U.S. Pat. No. 5,042,072, the pole piece of the motor is formed with a series of circumferentially spaced, longitudinally extending grooves or channels. Each channel extends radially inwardly from the outer surface of the pole piece toward its center, and from the top end of the pole piece to its bottom end including in the area of the magnetic gap between the pole piece and top plate. The purpose of the radial channels in the pole piece is to direct a flow of air along the voice coil as the air passes in and out of the dust cap cavity. Although it is contemplated that at least some of the air flow contacts the voice coil in this design, because the radial channels in the pole piece are oriented parallel to the voice coil along the longitudinal axis of the pole piece a limited amount of the cooling air actually impinges directly against the voice coil. Additionally, the formation of a number of radial channels in the pole piece reduces its mass in the area of the magnetic gap. This increases the reluctance of the magnetic path between the pole piece and top plate resulting in a decrease in motor strength which can adversely impact the acoustic performance of the speaker.

U.S. Pat. No. 5,357,586 to Nordschow employs a pole piece including a central through bore forming an annular wall defining a hollow interior. An aerodynamically-shaped insert is mounted within the central bore of the pole piece by a series of fins or spacers, thus forming longitudinally extending channels between the insert and the wall. Additionally, the wall of the pole piece is formed with a number of transverse bores extending between its outer surface and the central bore. In response to movement of the voice coil and diaphragm in one direction, air from outside of the speaker is drawn into the central bore of the pole piece, through its transverse bores, along the exterior surface of the pole piece into the magnetic gap between the pole piece and top plate, and then through bores formed in the voice coil into the dust cap cavity. Movement of the diaphragm in the reverse direction causes a flow of air out of the cavity through the voice coil bores, and then predominantly through the central bore of the pole piece along the channels formed by the fins of the aerodynamically-shaped insert.

Although the intention in the '586 patent is to cool the voice coil, it is unlikely that any effective cooling occurs with this design. The magnetic gap between the pole piece and top plate is exceedingly small, particularly considering that the voice coil is located therein, and no appreciable amount of air flow can be created through the magnetic gap without using a design such as described in the '072 Button patent wherein longitudinal channels are formed in the pole piece to provide a flow path between the pole piece and the top plate. The '586 patent does not include a pole piece with longitudinal channels along its exterior surface, but instead attempts to force a flow of air from the transverse bores in the pole piece through the magnetic gap, and, hence, along the outer surface of the voice coil. Additionally, the flow of air in the reverse direction noted above is for venting purposes only and does not result in the movement of cooling air along or adjacent to the wire winding of the voice coil.

The '707 patent to Wijnker is similar to Nordschow et al. in that it includes, in one embodiment, a pole piece formed with a central bore and a number of transverse bores extending through the wall of the pole piece. The transverse bores in the Wijnker patent are employed to create a flow of air from outside of the speaker, into the central bore of the pole piece and then out the transverse bores to discharge ports formed in the back plate of the speaker. No cooling air passes from the transverse bores, along the voice coil and into and out of the dust cap cavity. Alternative embodiments of the Wijnker patent disclose a flow path into and out of the dust cap cavity, but employ a pole piece formed with a through bore and no transverse bores and wherein an attempt is made, as in Nordschow et al., to force air to flow within the magnetic gap between the top plate and pole piece.

The deficiencies of such prior designs have been addressed to some degree in U.S. Pat. No. 6,243,479 to Proni and U.S. Pat. No. 6,535,613 to Ssutu. Each of these patents discloses a speaker having a motor which employs a pole piece formed with a bore. Structure is provided for directing a flow of air entering and exiting the pole piece bore(s) into contact with the inner surface of the voice coil in an area opposite the wire winding located on the outer surface of the voice coil. In the Ssutu design, the pole piece is formed with a through bore and an air deflector is inserted within the through bore at the top end of the pole piece. Air entering and exiting the dust cap cavity of the speaker as a result of axial movement of the voice coil and diaphragm contacts the air deflector and is directed against the inside surface of the voice coil opposite the wire winding to enhance cooling of the wire winding and top plate.

The Proni patent discloses a number of alternative embodiments, some where the pole piece is formed with a through bore and others in which the pole piece has an axial bore extending from the top end of the pole piece toward its bottom end. In most versions, the top end of the bore in the pole piece is closed by an insert, and transverse vent holes are formed in the side wall of the pole piece which intersect the axial bore or the central through bore therein. The axial bore or through bore, and the vent bores, cause air entering and exiting the dust cap cavity to flow directly against at least a portion of the interior of the former of the voice coil for cooling. Neither the Ssutu nor Proni design attempts to force a flow of air through the magnetic gap of the speaker. Instead, the cooling air is directed along the inner surface of the former of the voice coil to assist in cooling the wire winding on its opposite surface.

SUMMARY OF THE INVENTION

This invention is directed to a loudspeaker having a motor structure including a voice coil and a pole piece formed with a thorough bore, in which an air deflector is mounted over the outer surface of the pole piece within the interior of the voice coil in position to deflect air entering and exiting the dust cap cavity of the speaker into contact with the inner surface of the voice coil opposite its wire winding.

In the presently preferred embodiment, the air deflector comprises a larger diameter lower portion joined to a smaller diameter upper portion. Both the upper and lower portions are hollow with the lower portion having an open bottom and the upper portion being closed at its top end. A number of bores are formed in the deflector in the area of the juncture of the upper and lower portions.

The lower portion of the air deflector is placed over the outer surface of the pole piece of the motor structure, within the interior of the voice coil, and may extend along at least a portion of the magnetic gap formed between the pole piece and top plate of the motor. The air deflector is formed of copper which helps to optimize the inductance and impedance characteristics of the speaker. Additionally, with the deflector mounted to the pole piece, its bores are located in a position to direct air entering and exiting the dust cap cavity of the speaker, via the through bore in the pole piece, against the inner surface of the voice coil opposite its wire winding. This assists in cooling the voice coil during operation of the speaker.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Referring now to the FIGS., a loudspeaker 10 is illustrated which is identical in each of FIGS. 1, 3, 4 and 6 except for the inclusion of a different air deflector, described in detail below. Although the detailed construction of the speaker 10 forms no part of this invention, for purposes of the present discussion it is briefly described as follows.

Figure 3:
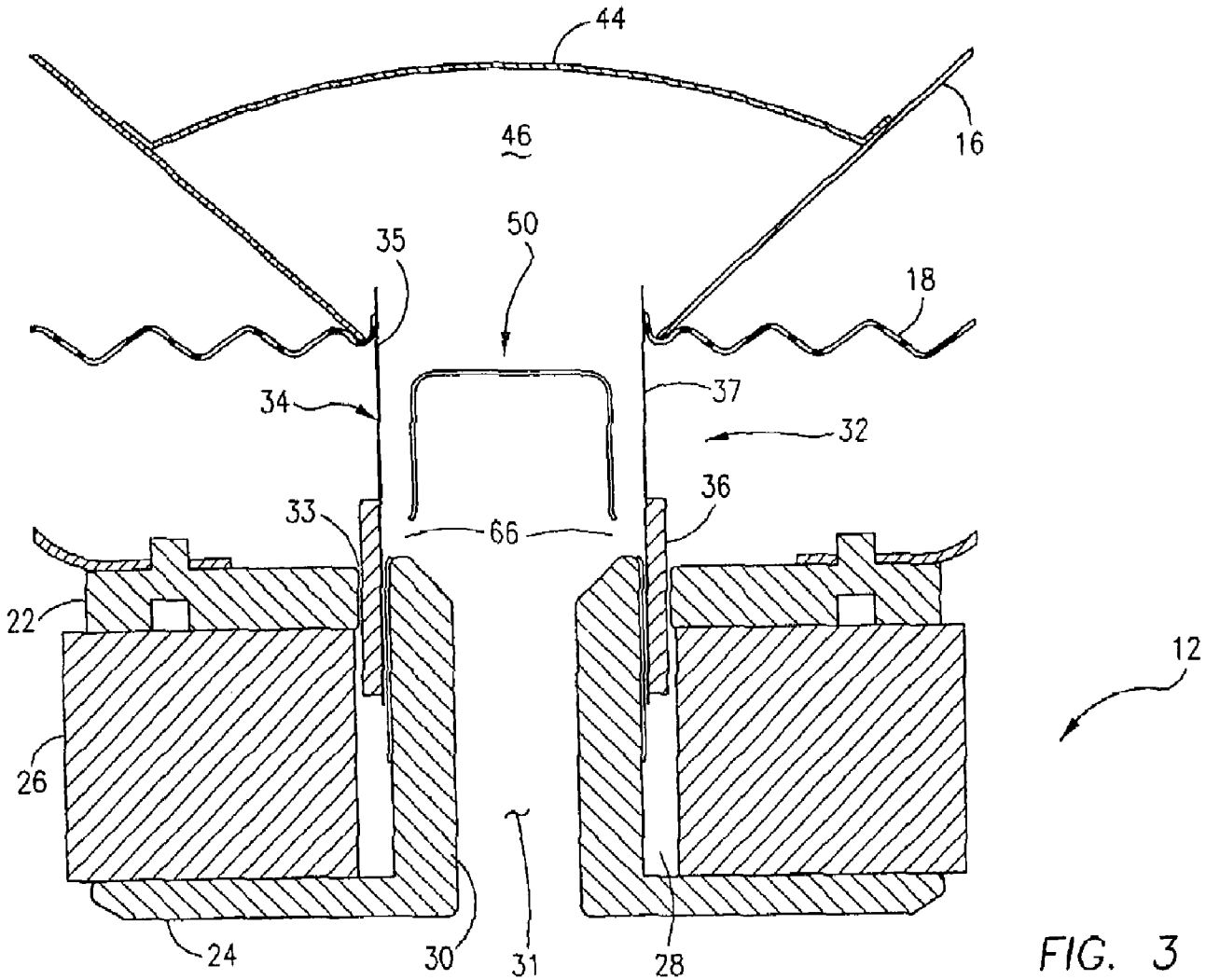
FIG. 3 is a further cross sectional view of the speaker shown in FIG. 1.
Figure 6:
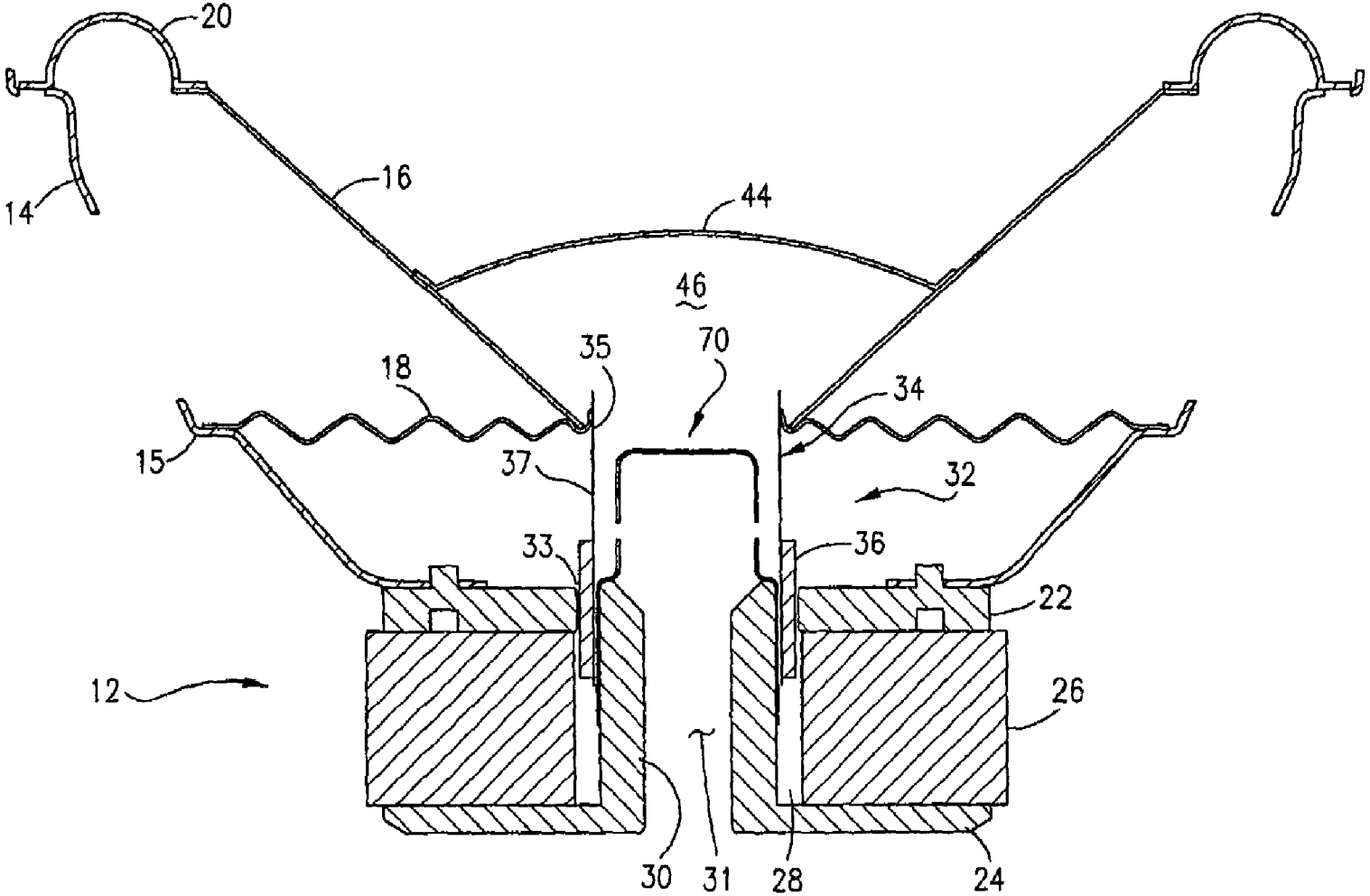
FIG. 6 is a further cross sectional view of the speaker of FIG. 4.

The speaker 10 generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a permanent magnet 26 between them. A pole piece 30 is integrally formed with and extends upwardly from the back plate 24 into a central bore 28 formed in both the magnet 26 and top plate 22. The pole piece 30 has a through bore 31 extending from its bottom end, which is exposed to ambient air, to its top end. A magnetic gap 33 is formed between the top plate 22 and the pole piece 30, as best seen in FIGS. 3 and 6. A voice coil 32 is also provided which includes a hollow, cylindrical-shaped former 34 having an inner surface 35 and an outer surface 37 which mounts a wire winding 36. The former 34 is concentrically disposed about the pole piece 30, and the voice coil 32 is axially movable within the magnetic gap 33 during operation of the speaker 10.

The voice coil 32 is held in place with respect to the pole piece 30 by the diaphragm 16, spider 18 and surround 20. One end of the diaphragm 16 is affixed to the former 34 by adhesive or the like, and its opposite end connects to the surround 20. The surround 20, in turn, is mounted to the upper end 38 of the frame 14 as shown. One end of the spider 18 connects to the former 34, and its opposite end mounts to a seat 15 formed in the frame 14.

A dust cap 44 is mounted to the diaphragm 16 in position to overlie the voice coil 32 and pole piece 30 in order to protect such elements from dirt, dust and other contaminants. A dust cap cavity 46 is therefore formed in the area defined by the lower portion of the diaphragm 16, the dust cap 44, the voice coil 32 and the pole piece 30. In response to the input of electrical energy to the wire winding 36, the voice coil 32 is moved axially with respect to the fixed motor structure 12. Because the diaphragm 16, spider 18, surround 20 and dust cap 44 are operatively connected to the voice coil 32, such elements also move with the excursion of the voice coil 32. A "pumping" action results from the axial movement of the diaphragm 16 and dust cap 44, which creates a flow of comparatively cool, ambient air from outside of the speaker 10 into and out of the cavity 46 via the through bore 31 in the pole piece 30.

The air deflector of this invention functions to vent the cavity 46 thus preventing pressure build up within the speaker 10, and also directs the flow of cooling air from outside of the speaker 10 against the inner surface 35 of the former 34, and, indirectly, against the wire winding 36 carried on the opposite outer surface 37 of the former 34. The structure of each embodiment of the air deflector of this invention is described first, followed by a discussion of its operation.

Figures 1, 2:
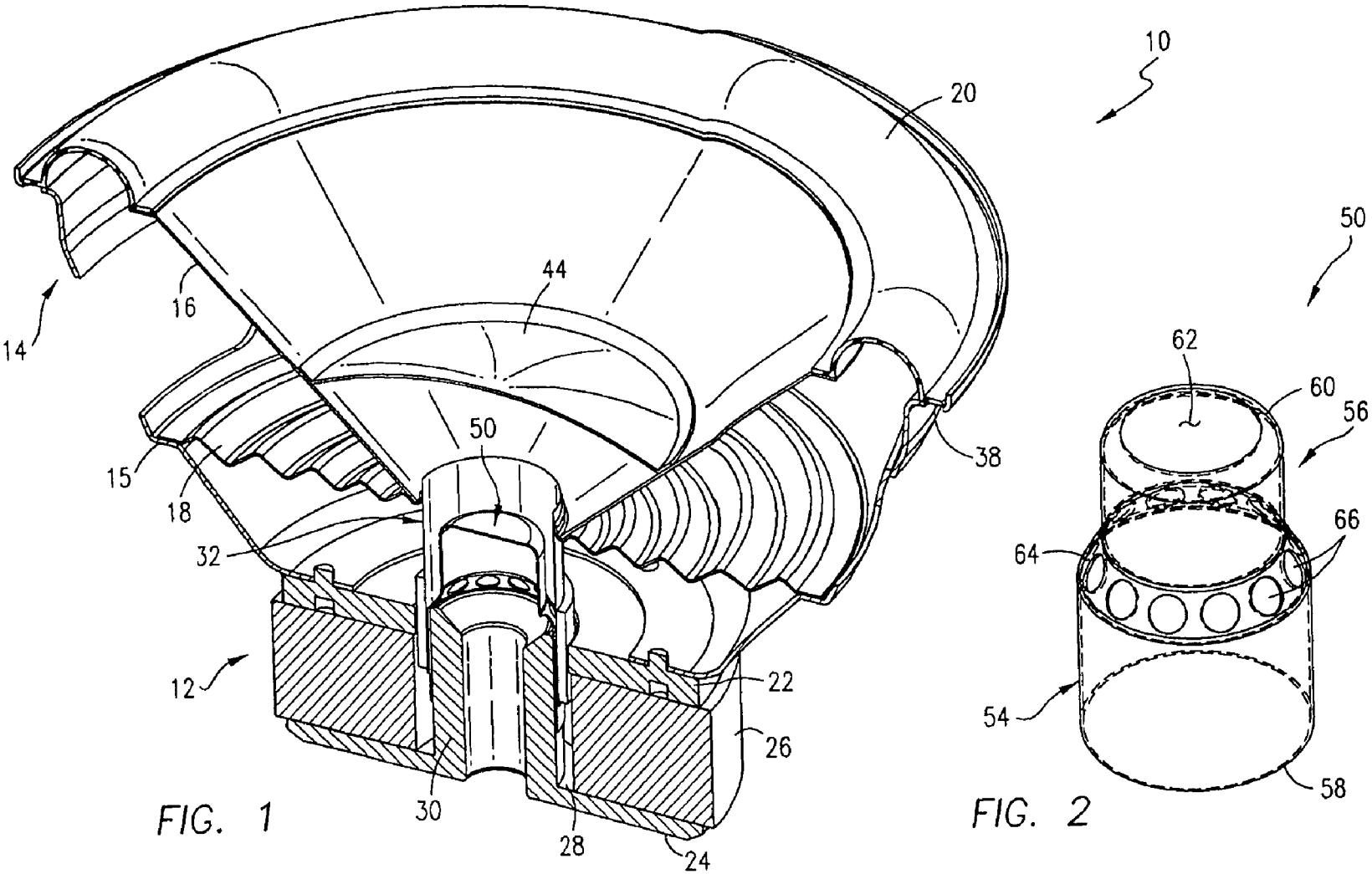
FIG. 1 is an elevational view, in partial cross section, of a speaker having one embodiment of the air deflector of this invention.
FIG. 2 is a perspective view of the air deflector depicted in FIG. 1.

With reference initially to FIGS. 1-3, one air deflector 50 of this invention comprises a sleeve preferably formed of copper having a larger diameter lower portion 54 joined to a smaller diameter upper portion 56. Both the lower portion 54 and upper portion 56 are hollow, with the bottom end 58 of the lower portion 54 being open and the top end 60 of the upper portion 56 being closed by a plate 62. The lower portion 54 is inwardly tapered at its juncture with the upper portion 56 forming a shoulder 64 having a number of circumferentially spaced bores 66 which extend into the hollow interior of the air deflector 50.

The air deflector 50 is mounted to the speaker 10 by sliding the lower portion 54 over the outer surface of the pole piece 30 until the shoulder 64 of the deflector 50 abuts the top end of the pole piece 30. The diameter of the lower portion 54 is chosen to frictionally engage the outer surface of the pole piece 30 so that the deflector 50 remains in place during operation of the speaker 10, while allowing the lower portion 54 to be readily slid along the pole piece 30 during assembly. As shown in FIGS. 1 and 3, when the deflector 50 is in position on the pole piece 30 it is located within the interior of the voice coil 32. The bores 66 in the shoulder 64 of the deflector 50 are positioned in the area of the former 34 opposite at least a portion of the wire winding 36 of the voice coil 32.

Figure 5:
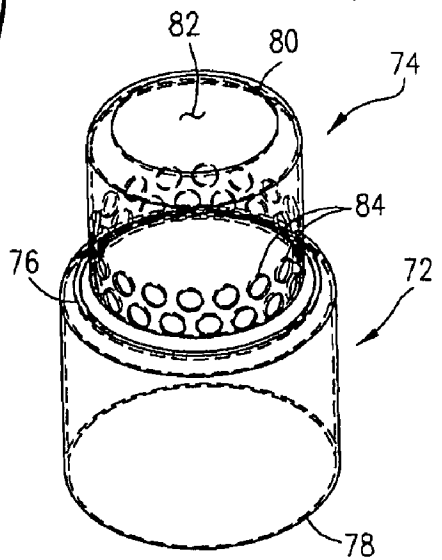
FIG. 5 is a perspective view of the air deflector shown in FIG. 4.
Figure 4:
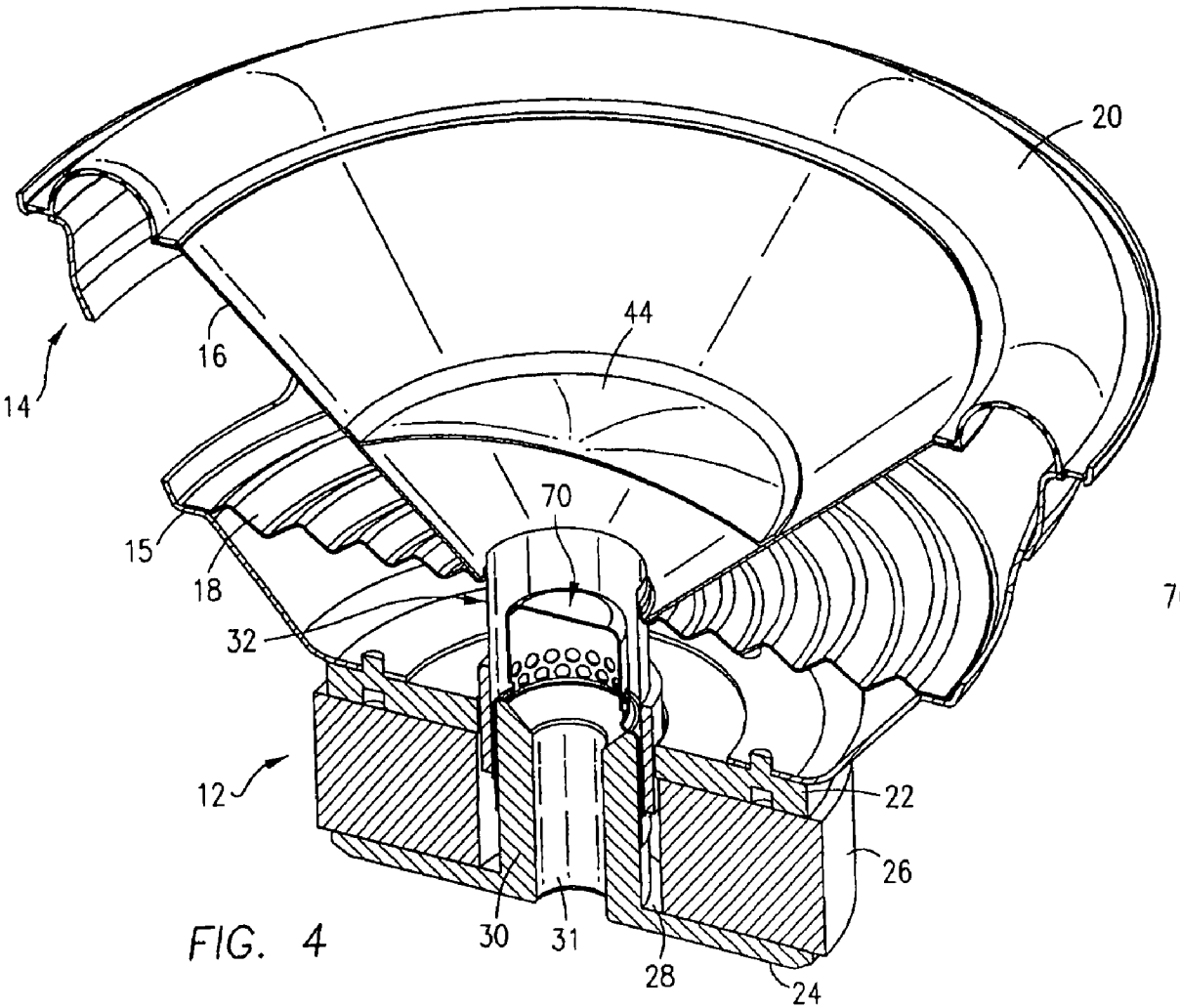
FIG. 4 is view similar to FIG. 1, except of an alternative embodiment of the air deflector of this invention.

Referring now to FIGS. 4-6, a second air deflector 70 is depicted with the same loudspeaker 10 shown in FIGS. 1-3 and described above. The deflector 70 is similar to deflector 50 and comprises a hollow lower portion 72 connected to an upper portion 74 at an inwardly tapering joint 76. The lower portion 72 is open at its bottom end 78 and the top end 80 of upper portion 74 is closed by a plate 82. A number of bores 84 are formed in the upper portion 74, immediately above the joint 76, and these bores 84 are preferably circumferentially spaced from one another and may form one or more rows extending from the joint 76 toward the top end 80 of top portion 74.

The air deflector 70 is mounted to the speaker 10 in a manner similar to the deflector 50. The lower portion 72 is slid over the outer surface of the pole piece 30 until the tapered joint 76 of the deflector 70 contacts the top end of the pole piece 30. The diameter of the lower portion 72 is chosen to frictionally engage the outer surface of the pole piece 30 so that the deflector 70 remains in place during operation of the speaker 10, while allowing the lower portion 72 to be readily slid along the pole piece 30 during assembly. As best seen in FIGS. 4 and 6, when the deflector 70 is in position on the pole piece 30 it is located within the interior of the voice coil 32. The bores 84 in the top portion 74 of the deflector 70 are positioned in the area of the former 34 opposite at least a portion of the wire winding 36 of the voice coil 32.

As shown in the FIGS., the lower portion 54 of deflector 50 and lower portion 72 of deflector 70 may, although do not necessarily, extend along the pole piece 30 throughout the length of the magnetic gap 33. This construction, coupled with the fact that each of the deflectors 50 and 70 is formed of copper, assists in optimizing the inductance and impedance characteristics of the speaker 10.

Speaker Operation

As described above, during operation of the speaker 10 the voice coil 32 is moved axially with respect to the fixed motor structure 12. The diaphragm 16, spider 18, surround 20 and dust cap 44 move as a unit with the excursion of the voice coil 32 to create a "pumping" action causing comparatively cool air from outside of the speaker 10 to flow in and out of the dust cap cavity 46 inside of the speaker 10. In response to movement of the voice coil 32 in one direction, air from outside of the speaker 10 enters the through bore 31 of the pole piece 30 and flows in a direction toward the dust cap cavity 46. When the voice coil 32 reverses direction, air exits the dust cap cavity 46 and flows through bore 31 of the pole piece 30 out of the speaker 10.

With an air deflector 50 or 70 in place as described above, the flow of air into and out of the dust cap cavity 46 is deflected and directed into contact with the inner surface 35 of the former 34 of the voice coil 32 in the area opposite the wire winding 36. The relatively cool air entering the through bore 31 of the pole piece 30 from outside of the speaker 10 is blocked from directly flowing into the dust cap cavity 46 by the closed top end of deflector 50 or 70. Instead it must pass through the bores 66 of deflector 50 or bores 84 of deflector 70. These bores 66 or 84 direct the cooling air against the inner surface 35 of the voice coil former 34, and then the air continues into the dust cap cavity 46. When the air exits the dust cap cavity 46, it must flow along the inner wall 35 of the former 34 opposite the wire winding 36 before entering the bores 66 or 84 leading to the through bore 31 of the pole piece 30. This flow path created by the air deflectors 50 and 70 assists in cooling the voice coil 32, and also provides venting for the dust cap cavity 46.

The bores 66 in air deflector 50 and the bores 84 in air deflector 70 are shown in the FIGS. as generally aligning with at least some of the wraps of the wire winding 36 on the outer surface 37 of the voice coil former 34. Particularly with high excursion speakers, such as subwoofers, the position of the wire winding 36 changes significantly with the movement of the voice coil 32 during speaker operation. Nevertheless, it is contemplated that a substantial portion of the inner surface 35 of the former 34 opposite the wire winding 36 will be impacted and cooled by the air flow from deflectors 50 and 70.

Although the air deflectors 50 and 70 may be employed in subwoofers, it is contemplated that they may be especially useful in smaller, midrange speakers. Both air deflectors 50 and 70 are easily manufactured at relatively low cost, thus providing an efficient but modestly priced structure for enhancing cooling of the voice coil 32.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the speaker 10 of this invention is illustrated with a dust cap 44 connected to the diaphragm 16 in position overlying the voice coil 32 and pole piece 30. In this construction, the dust cap cavity 46 is formed by the diaphragm 16, dust cap 44, voice coil 32 and pole piece 30. It is also contemplated that the dust cap 44 could be removed, and the diaphragm 16 directly connected to the top end of the voice coil 32 thus forming a cavity (not shown) in an area beneath the diaphragm 16, overlying the voice coil 32 and pole piece 30, without a dust cap 44. The term "dust cap cavity" as used herein is therefore also intended to apply to such cavity where the dust cap 44 is removed.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including a pole piece having an outer surface and a through bore, a top plate spaced from said outer surface of said pole piece to form a magnetic gap, and a voice coil moveable within said magnetic gap, said voice coil having an inner surface, an outer surface and a hollow interior;

a frame mounted to said motor structure;

an upper suspension connected to said frame;

a diaphragm connected between said upper suspension and said voice coil, a cavity overlying said voice coil which is at least partially formed by said diaphragm;

a lower suspension connected between said frame and said voice coil;

an air deflector having an upper portion formed with a closed end, a lower portion connected to said upper portion and being formed with an open end and at least one bore located between said open and closed ends, said air deflector being mounted to said pole piece by sliding said lower portion along said outer surface of said pole piece, said lower portion frictionally engaging said outer surface of said pole piece to maintain said air deflector in position thereon and within said hollow interior of said voice coil, whereby a flow of air passing between said through bore of said pole piece and said cavity in response to movement of said voice coil is directed by said at least one bore of said air deflector into contact with said inner surface of said voice coil.

2. The loudspeaker of claim 1 in which said lower portion of said air deflector has a larger diameter that said upper portion.

3. The loudspeaker of claim 1 in which said air deflector includes a tapered wall formed at the juncture of said upper and lower portions, said tapered wall having a number of circumferentially spaced bores.

4. The loudspeaker of claim 1 in which said lower portion of said air deflector has a larger diameter than said upper portion, said upper portion being formed with a number of circumferentially spaced bores.

5. The loudspeaker of claim 1 in which said air deflector is formed of copper.

6. The loudspeaker of claim 1 in which said lower portion of said air deflector frictionally engages said outer surface of said pole piece to maintain said air deflector in position thereon such that at least part of said lower portion is located within said magnetic gap between said pole piece and said top plate.

7. A loudspeaker, comprising:

a motor structure including a pole piece having an outer surface and a through bore, a top plate spaced from said outer surface of said pole piece to form a magnetic gap, and a voice coil moveable within said magnetic gap, said voice coil having an inner surface, an outer surface and a hollow interior;

a frame mounted to said motor structure;

an upper suspension connected to said frame;

a diaphragm connected between said upper suspension and said voice coil, a cavity overlying said voice coil which is at least partially formed by said diaphragm;

a lower suspension connected between said frame and said voice coil;

an air deflector having an upper portion formed with a closed end, a lower portion connected to said upper portion and being formed with an open end and at least one bore located between said open and closed ends, said air deflector being mounted to said pole piece by sliding said lower portion along said outer surface of said pole piece, said lower portion frictionally engaging said outer surface of said pole piece to maintain said air deflector in position thereon such that at least part of said lower portion is located within said magnetic gap between said pole piece and said top plate, whereby a flow of air passing between said through bore of said pole piece and said cavity in response to movement of said voice coil is directed by said at least one bore of said air deflector into contact with said inner surface of said voice coil.

* * * * *